United States Patent [19]

Wong

[11] Patent Number: 4,526,756

[45] Date of Patent: Jul. 2, 1985

[54] DEVICE FOR INTERCONNECTING SPECIMEN COLLECTING TUBES

[75] Inventor: Johnson N. S. Wong, Rolling Hills, Calif.

[73] Assignee: Evergreen Industries, Inc., Los Angeles, Calif.

[21] Appl. No.: 687,040

[22] Filed: Dec. 28, 1984

Related U.S. Application Data

[63] Continuation of Ser. No. 376,443, May 10, 1982, abandoned.

[51] Int. Cl. ..... B01L 9/00

[52] U.S. Cl. ..... 422/104; 24/16 PB; 24/17 AP; 206/443

[58] Field of Search ..... 422/104, 102, 103, 99, 422/65; 220/23.4, 23.8; 206/443; 211/74; 248/313, 74.3, 74.5, 74 PB, 74 B; 24/16 PB, 30.5 P, 17 AP

[56] References Cited

U.S. PATENT DOCUMENTS

| | | | |
|---|---|---|---|
| 2,898,741 | 8/1959 | Milliken . | |
| 2,949,203 | 8/1960 | Berg | 220/23.4 |
| 3,019,500 | 2/1962 | Duffin et al. . | |
| 3,033,412 | 5/1962 | Fox | 220/23.4 |
| 3,154,281 | 10/1964 | Frank | 248/74.3 |
| 3,164,478 | 1/1965 | Bostrom | 229/2.5 |
| 3,175,695 | 3/1965 | Goodman et al. | 248/313 |
| 3,305,086 | 2/1967 | Hartman | 229/2.5 |
| 3,501,814 | 3/1970 | Anderson et al. | 24/16 PB |
| 3,521,332 | 7/1970 | Kramer | 248/74.3 |
| 3,521,785 | 7/1970 | Bergmann et al. | 422/104 |
| 3,543,355 | 12/1970 | Wyckoff et al. . | |
| 3,684,223 | 8/1972 | Logsdon | 248/74.3 |
| 3,684,453 | 8/1972 | Lartigue et al. | 422/102 |
| 3,786,982 | 1/1974 | Rakes et al. | 229/2.5 R |
| 3,875,623 | 4/1975 | Johnston . | |
| 3,882,619 | 5/1975 | Durand | 248/313 |
| 3,894,706 | 7/1975 | Mizusawa | 248/74.3 |
| 3,905,772 | 9/1975 | Hartnett et al. | 422/102 |
| 3,906,592 | 9/1975 | Sakasegawa et al. | 248/68 R |
| 4,172,578 | 10/1979 | Pate | 248/74 R |
| 4,224,721 | 9/1980 | Ohlson | 248/68 CB |
| 4,291,855 | 9/1981 | Schenkel et al. | 248/74.3 |
| 4,317,262 | 3/1982 | Wells | 248/74.5 |
| 4,334,659 | 6/1982 | Yuda | 248/74 A |
| 4,349,571 | 9/1982 | Davis et al. | 229/2.5 R |
| 4,378,617 | 4/1983 | Burns | 248/74 PB |

FOREIGN PATENT DOCUMENTS

| | | | |
|---|---|---|---|
| 560916 | 4/1957 | Italy . | |
| 988602 | 4/1965 | United Kingdom | 206/443 |

*Primary Examiner*—Steven Weinstein

*Attorney, Agent, or Firm*—Nilsson, Robbins, Dalgarn, Berliner, Carson & Wurst

[57] ABSTRACT

A device for retaining at least two specimen collecting tubes in a preselected spaced relationship includes an elongate structure having first and second arm portions joined by a flexible hinge portion, each of the arm portions defining a first surface engageable with a first tube and a second surface engageable with a second tube. The device includes provision for joining the arm portions to each other at locations remote from the hinge portion to confine the tubes between the arm portions.

8 Claims, 6 Drawing Figures

FIG. 1
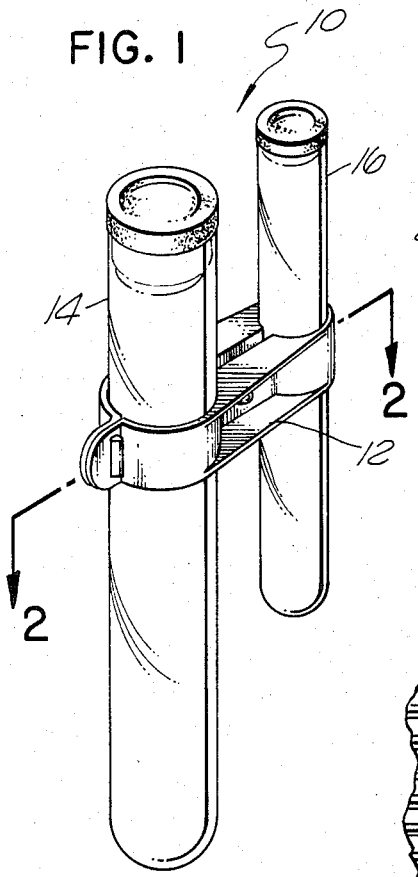
FIG. 2
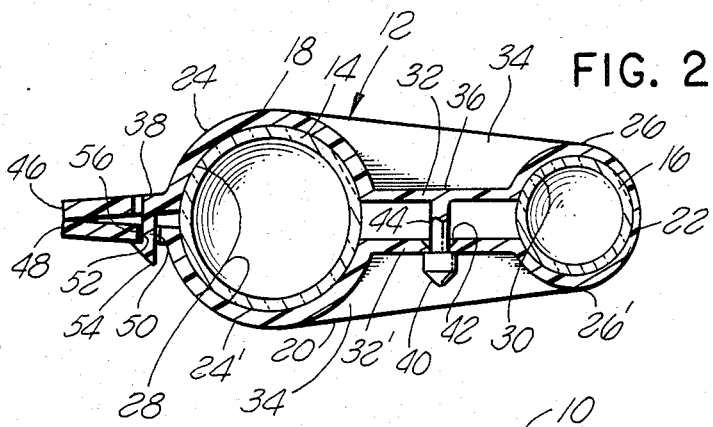
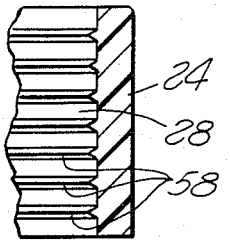
FIG. 5
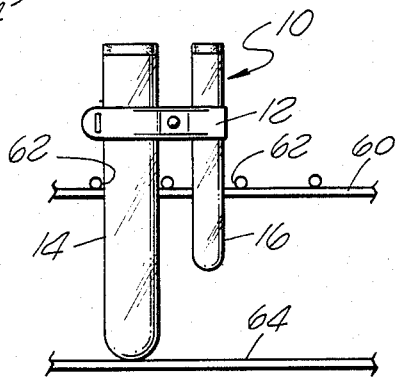
FIG. 6
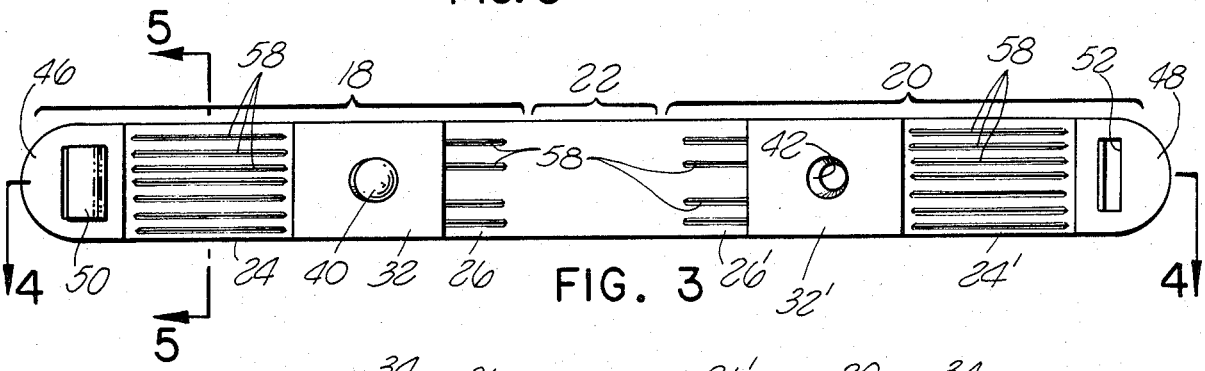
FIG. 3
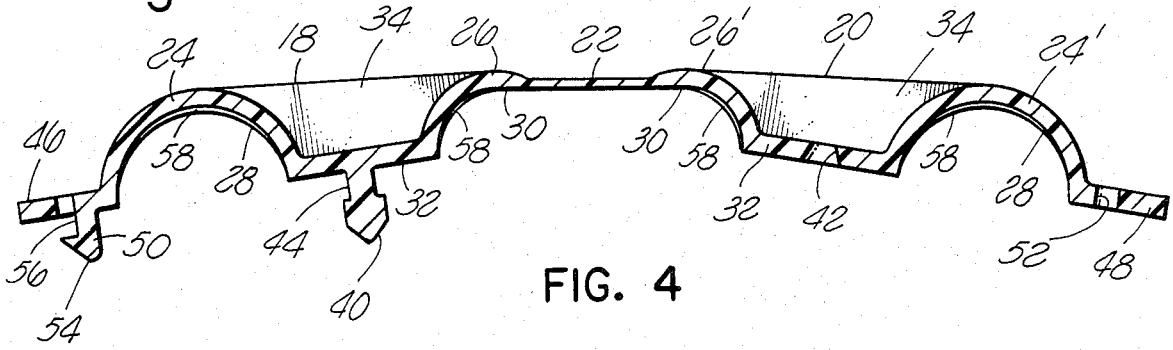
FIG. 4

DEVICE FOR INTERCONNECTING SPECIMEN COLLECTING TUBES

This is a continuation of application Ser. No. 376,443, filed May 10, 1982, now abandoned.

BACKGROUND OF THE INVENTION

The present invention relates to a device for retaining at least two specimen collecting tubes in a preselected spaced relationship and, more particularly, to a clamp for interconnecting tubes containing separated phases of a body fluid, such as blood.

It is universally required that samples of blood drawn for cross-matching in connection with blood transfusions be centrifuged and that the serum be separated therefrom immediately after clotting. This procedure curtails auto absorption. The phases of blood obtained in this way must be maintained in a separated condition and identified with the patient for future reference.

Systems have been devised for correlating the various samples and units of blood taken from a particular patient and identifying them with the patient. One such system includes a pair of specimen container tubes having color coded stoppers and suitable patient identifying indicia which is also found on a wrist band worn by the patient. However, the specimen containing tubes of such systems are likely to become separated or lost, causing valuable time to be lost in locating them before a blood transfusion can be administered. Although it is possible to maintain the tubes for a given patient in close proximity in a tube rack, it is both inconvenient and time consuming to cross check the indicia on the tubes each time they are removed from the rack. The possibility also exists that a worker in an emergency will pull a clot tube from one patient and a serum tube from another.

Attempts have also been made to physically connect the clot and serum tubes of each patient to avoid confusion and assure proper match. In some cases, the clot and serum tubes are held together by tape and rubber bands. However, tubes connected in this way are difficult to maintain upright because they do not fit within conventional tube racks.

Another proposal for correlating specimen tubes is disclosed in pending U.S. patent application Ser. No. 199,251, filed Oct. 21, 1980, now abandoned, by Mark O. Walker. The Walker application relates to a spacer positioned between a pair of collecting tubes to hold the tubes together. The spacer is adhesively bonded at one side to a clot tube and is either formed integrally with or adhesively bonded to a serum tube at its other side. However, the Walker structure can be somewhat expensive to produce and assemble due to the use of adhesives. It is also possible that the adhesive will fail, causing the tubes to become separated. When the spacer is formed integrally with the serum tube, the proposal requires a nonstandard tube which increases cost.

Therefore, in many applications it is desirable to provide a device and system for holding related specimens of body fluids together indefinitely and permitting the specimens to be easily stored in that condition.

SUMMARY OF THE INVENTION

The present invention includes a device for retaining at least two specimen collecting tubes in a preselected spaced apart relationship, comprising an elongated structure having first and second arm portions joined by a flexible hinge portion, each of the arm portions defining a first surface engageable with a first specimen collecting tube and a second surface engageable with a second specimen collecting tube, the surfaces of the two arm portions being positioned symmetrically relative to the hinge portion, and means for joining the arm portions to each other at locations remote from the hinge portion to confine the tube between the arm portions. In a preferred embodiment, the arm portions are formed integrally with the hinge portion and the elongate structure is formed of a suitable injection molded polymeric material. The joining means may then comprise at least one enlarged projection on one of the arm portions which is receivable within a restricted opening of the other arm portion, the projection having an undercut portion engageable with the restricted opening when the projection is received therein.

The device of the present invention is suitable for frictionally holding a pair of specimen collecting tubes in a spaced relationship. The tubes can be handled together and readily identified as belonging to the same patient. The tubes themselves are conventional evacuated blood sampling tubes or other suitable tubes of appropriate diameter. In addition, the connected tubes can be stored in an upright condition within adjacent openings of a conventional tube rack.

The simplicity of the clamp device of the present invention permits it to be manufactured inexpensively and to produce highly consistent results. The flexible "living hinge" formed between the first and second arm portions permits the clamp to be mass produced by injection molding in an open condition from an organic polymeric material. The hinge portion is much thinner than the arm portions, causing it to experience substantial deformation between the open condition of formation and the closed condition of use.

The clamp device of the present invention is thus suitable for use as a "one shot" device for assembly about a pair of conventional collector tubes just prior to use. After use, the tubes and the clamp can be discarded as a unit. The device can be produced inexpensively and is assembled by simply snapping it in place around the tubes. Expenses for material and labor are thus minimized while providing an extremely workable solution to the problem of correlating blood specimens.

BRIEF DESCRIPTION OF THE DRAWINGS

The above and other features of the present invention may be more fully understood from the following detailed description, taken together with the accompanying drawings, wherein similar reference characters refer to similar elements throughout and in which:

FIG. 1 is a perspective view of the tube clamp device of the present invention assembled about a pair of specimen collecting tubes;

FIG. 2 is a horizontal sectional view taken along the line 2—2 of FIG. 1;

FIG. 3 is a front elevational view of the tube clamp device of FIG. 1 in the open condition;

FIG. 4 is a horizontal sectional view taken along the line 4—4 of FIG. 3;

FIG. 5 is an enlarged vertical sectional view taken along the line 5—5 of FIG. 3; and FIG. 6 is an elevational view of the apparatus of FIG. 1 in position within a conventional tube rack.

DESCRIPTION OF THE PREFERRED EMBODIMENTS

Referring now to the drawings, there is illustrated in FIGS. 1 and 2 an apparatus constructed according to the present invention, generally designated 10. The apparatus 10 comprises a clamp device 12 positioned around a first tube 14 and a second tube 16 to frictionally retain the tubes in a preselected spaced apart condition. The tubes 14 and 16 are preferably conventional specimen collecting tubes for reception of different phases of blood or other body fluid from a particular patient. Upon drawing one or more specimens, the clamp 12 is positioned about the tubes to prevent them from being lost or confused with tubes containing specimens from other patients. When the specimens are no longer needed, the entire apparatus can be discarded as a unit.

Referring to FIGS. 2, 3 and 4, the clamp 12 comprises a first arm 18 and a second arm 20 connected by a living hinge 22. The first and second arms are in large part mirror images of each other. The first arm 18 includes a first arcuate portion 24 and a second arcuate portion 26, and the second arm 20 comprises a first arcuate portion 24' and a second arcuate portion 26'. The first and second arcuate portions of the respective arms are positioned symmetrically relative to the hinge 22, forming a first composite surface 28 for engaging the tube 14 and a second composite surface 30 for engaging the tube 16.

The arcuate portions of the arms 18 and 20 are connected together by substantially flat surface portions 32 and 32', respectively, and by a plurality of horizontal strengthening flanges 34. The flat portions 32 and 32' extend between adjacent ends of the corresponding arcuate portions, while the flanges 34 are perpendicular to the flat portions. The flanges 34 and the substantially flat portions 32 combine with the arcuate portions to provide substantially rigid portions along the greater part of each of the arms. Flexing of the clamp 12 is substantially limited to the living hinge 22 and the outer ends of the first arcuate portions 24 and 24'.

The "living hinge" 22 is formed of a relatively thin strap of organic polymeric material extending between the second arcuate portion 26 and the second arcuate portion 26'. In the preferred embodiment in which the clamp is a single injection molded plastic part, the hinge is made of the same material as the remainder of the clamp. The greater flexibility of the hinge results from its configuration and relative thinness. When the clamp 12 is formed of polypropylene or other suitable injection moldable material, it can be repeatedly flexed open and closed relative to the hinge 22 without damaging the hinge in any way. The hinge is thus "living" in the sense that it is not detrimentally affected by such flexing movement.

In the condition of FIG. 2, the first and second arms are held about the tubes 14 and 16 by a central connecting structure 36 and an outer connecting structure 38. The central connecting structure 36 comprises an enlarged projection 40 extending from the flat portion 32 for engagement with a tapered opening 42 of the flat portion 32'. The projection 40 is preferably pointed for ease of reception within the tapered opening 42, and is provided with an undercut portion or stem 44 engageable with the opening after the projection has been passed therethrough. The opening 42 is then permitted to recover inwardly toward the undercut portion 44, preventing the projection from being easily withdrawn. Thus, the projection 40 snaps readily through the opening 42 to connect the flat portions 32 and 32' when the clamp device is positioned about the collecting tubes, and is held in that position in the absence of a much greater force in the opposite direction. It will be noted that in the engaged condition of the connecting structure 36, the flat portions 32 and 32' are held substantially parallel to each other, as shown in FIG. 2. This forces the second composite surface 30 and the living hinge 22 into a circular configuration about the tube 16, causing the clamp 12 to uniformly grip the two tubes.

The outer connecting structure 38 is provided with a pair of ears 46 and 48 which extend outwardly from the free ends of the first arcuate portions 24 and 24'. The connecting structure 38 includes a projection 50 of the ear 46 which is received within an opening 52 of the ear 48. The projection 50 is provided with a tapered end 54 for ease of insertion into the opening, and with an undercut portion 56 for engaging the opening in the manner of the undercut portion 44 discussed above. The projection 50 and the opening 52 are preferably in the form of a tongue and a slot, respectively, for engagement as shown in FIG. 2. The connecting structure 38 acts in much the same way as the connecting structure 36 described above, in that the tapered end 54 of the projection 50 is able to snap rather readily through the opening 52 to connect or join the two ears, but will not disconnect unless a much greater force is applied in the opposite direction.

The connecting structures 36 and 38 permit the clamp 12 to be quickly and easily assembled about a pair of specimen collecting tubes without the need for tools or special training. The result is a force fit between the arcuate surfaces and the corresponding tubes. The friction between the arcuate surfaces and the tubes is controlled by a plurality of tube engaging ribs 58 on the arcuate surfaces, as seen most clearly in FIG. 5. The tubes are thus held indefinitely within the clamp against the forces encountered in handling of the tubes, but either or both of the tubes can be pulled axially from the clamp for individual centrifuging or other processing. Upon completion of processing, the tube can be reinserted into the clamp for continued correlation of the samples.

As seen in FIG. 6, the apparatus 10 can be inserted within a conventional tube rack 60 in its assembled condition. Each of the individual tubes engages one of the tube openings 62 of the rack. The first tube 14 will generally be somewhat longer than the second tube 16, and will also engage a bottom 64 of the rack to hold the apparatus in position. Although the rack depicted in FIG. 6 is a cross-wire rack, the principal illustrated therein is applicable to a wide variety of conventional tube racks.

In practice, a nurse or medical technician will typically close the clamp 12 by engaging the connecting structures 36 and 38 before inserting the tubes therein. In the preassembled condition, the composite surface 30 forms an oblong opening with the living hinge 22. This occurs because the living hinge is the most flexible part of the clamp and therefore the most easily distorted when the clamp is closed. The surface 30 and the hinge 22 are subsequently forced into a circular configuration by insertion of the second tube 16. Since the arms 18 and 20 are joined by the projection 40 and are substantially rigid adjacent thereto, they act as a "scissors" type of arrangement to reduce the circumference of the first composite surface 28 when the second tube 16 is inserted. The first composite surface is then prepared to receive the first tube 14, after which the apparatus 10 is fully assembled to apply a uniform frictional force to the tubes. Suitable identifying indicia (not shown) may be applied to the apparatus 10 at this time, if desired. As discussed above, the apparatus 10 may be discarded after a single use.

In the field of cross-matching blood, the first tube 14 is typically an evacuated blood sampling tube of the type available commercially from a number of sources and the tube 16 is a smaller serum tube for retaining blood serum from a drawn sample which has been centrifuged. The sizes of the tubes depend primarily upon the circumstances of their use and the clamp 12 must be dimensioned to produce a force fit of the tubes therein.

Although the present invention has been described primarily in relation to use in the cross-matching of blood, it is anticipated that the apparatus will find application in a variety of other fields wherein sets of fluids must be correlated for future testing or inspection.

From the above, it can be seen that there has been provided an improved disposable apparatus for releasably holding a plurality of specimen collecting tubes together.

What is claimed is:

1. A device for retaining at least two specimen collecting tubes in a preselected spaced relationship, comprising an elongate structure having first and second arm positions joined by a flexible hinge portion, each of the arm portions defining a first arcuate surface engageable with a first specimen collecting tube and a second arcuate surface engageable with a second specimen collecting tube with the first and second arcuate portions of the respective arms being positioned symmetrically relative to said hinge portion, each of said arm portions further having a substantially flat surface portion extending between the first and second arcuate surfaces, said flat surface portion including means for connecting the arms to each other so that the flat surface portions between the arcuate surfaces are in a substantially parallel spaced apart relationship to confine the tubes between the arm portions and second means for connecting the arms to each other at substantially the extremity of the arms remote from the hinge portion.

2. The device recited in claim 1 wherein the arm portions are formed integrally with the hinge portion.

3. The device recited in claim 2 wherein the elongate structure is formed of injection molded organic polymeric material.

4. The device recited in claim 2 wherein the hinge portion is a strap of the elastomeric material which is substantially thinner than the arm portions.

5. The device recited in claim 1 wherein at least one of said means for connecting comprises at least one enlarged projection on one of the arm portions and a restricted opening in the other arm portion, the projection being receivable within the restricted opening and having an undercut portion engageable with the opening when the projection is received therein.

6. The device recited in claim 5 wherein the enlarged projection is tapered to facilitate reception within the restricted opening.

7. The device recited in claim 5 wherein the first and second arcuate surfaces have a plurality of ribs thereon for frictionally retaining the tubes therebetween.

8. The device recited in claim 1 wherein each arm portion is substantially rigid in the area adjacent to the flat surface portion thereof.

* * * * *